US006903358B2

(12) United States Patent
Kim

(10) Patent No.: US 6,903,358 B2
(45) Date of Patent: Jun. 7, 2005

(54) PAPER THICKNESS DETECTING DEVICE

(75) Inventor: Kyung-Hoon Kim, Pyeongtaek (KR)

(73) Assignee: LG N-Sys Inc., Seoul (KR)

( * ) Notice: Subject to any disclaimer, the term of this patent is extended or adjusted under 35 U.S.C. 154(b) by 164 days.

(21) Appl. No.: 10/320,668

(22) Filed: Dec. 17, 2002

(65) Prior Publication Data

US 2003/0116724 A1 Jun. 26, 2003

(30) Foreign Application Priority Data

Dec. 24, 2001 (KR) ..... 2001-84276

(51) Int. Cl.[7] ..... G01N 21/86; G01V 21/86

(52) U.S. Cl. ..... 250/559.27; 250/225; 271/262; 271/265.04; 356/630; 400/56

(58) Field of Search ..... 250/559.27, 221, 250/222.1, 225, 229; 272/262, 265.04; 356/630; 400/56

(56) References Cited

U.S. PATENT DOCUMENTS 4,792,227 A * 12/1988 Yoshizawa ..... 356/128
5,743,521 A * 4/1998 Munakata et al. ..... 271/263
5,806,992 A * 9/1998 Ju ..... 400/56
5,971,392 A * 10/1999 Lee ..... 271/265.02
6,646,753 B2 * 11/2003 Zhang et al. ..... 356/632
6,669,186 B2 * 12/2003 Tunink et al. ..... 271/9.11
6,734,417 B2 * 5/2004 Vejtasa ..... 250/231.13

* cited by examiner

*Primary Examiner*—Stephone B. Allen
*Assistant Examiner*—Patrick J. Lee
(74) *Attorney, Agent, or Firm*—Fleshner & Kim, LLP

(57) ABSTRACT

Embodiments of the present invention relate to an apparatus (i.e. an automatic teller machine) comprising an optical sensor. The optical sensor is configured to detect thickness of paper. Advantages of some embodiments of the present invention are that by determining a thickness of paper, it can be confirmed that two pieces of paper are not stuck together. For example, if two substantially identical pieces of paper are stuck together, then their thickness will be approximately twice the thickness of a single sheet. Accordingly, upon detection of two or more sheets of paper stuck together, a device, that automatically handles paper, may cause the sheets of paper to be separated.

22 Claims, 3 Drawing Sheets

PAPER THICKNESS DETECTING DEVICE

BACKGROUND OF THE INVENTION

1. Field of the Invention

The present invention relates to detecting thickness of paper.

2. Background of the Related Art

Devices that automatically handle paper (i.e. photocopy machines) are commonplace. These devices are useful, so that large amounts of paper can be handled efficiently and effectively (i.e. making a photocopy of a large document). Devices that handle paper must have mechanisms that replicate manual handling of paper. For example, photocopy machines have feeders for moving paper, sheet by sheet.

A normal manual function of handling paper is for a person to use their hands to confirm that two sheets of paper are not stuck together. This is important, as if two sheets of paper are stuck together, paper may be wasted or inaccurately dispensed. If devices that automatically handle paper do not confirm if two sheets of paper are stuck together, then these devices may be ineffective in accurately automatically handling paper. Accordingly, there has been a long felt need for devices that automatically handle paper to confirm that two sheets of paper are not stuck together. Further, there has been a long felt need for this confirmation to be accomplished at a reasonable price.

SUMMARY OF THE INVENTION

Objects of the present invention at least include overcoming the disadvantages of the related art. Embodiments of the present invention relate to an apparatus (i.e. an automatic teller machine) comprising an optical sensor. The optical sensor is configured to detect thickness of paper. Advantages of some embodiments of the present invention are that by determining a thickness of paper, it can be confirmed that two pieces of paper are not stuck together. For example, if two substantially identical pieces of paper are stuck together, then their thickness will be approximately twice the thickness of a single sheet. Accordingly, upon detection of two or more sheets of paper stuck together, a device, that automatically handles paper, may cause the sheets of paper to be separated.

In embodiments, the optical sensor comprises a light source, a light detector, and an interference substrate. The light detector is configured to receive light from the light source. The interference substrate is configured to change a quantity of light received at the light detector according to the thickness of a sheet of paper. For example, the light source may be directed to the light detector. The interference substrate may be movable and place in the light path between the light source and the light detector. Movement of the interference substrate may effect the amount of light received at the light detector. Further, movement of the interference substrate may correspond to the thickness of a sheet of paper. Accordingly, the thickness of a sheet of paper may be determined by the amount of light received at the light detector.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

DETAILED DESCRIPTION OF PREFERRED EMBODIMENTS

Automatic teller machines (ATM), photocopiers, and printers may include a plurality of conveyance rollers and/or idle rollers which can withdraw medium such as bills, copy papers and print papers one by one from a cassette and convey it to a follow-up device. Thickness measuring devices may be provided at one side of a conveyance roller to measure thickness of a passing medium. The passing medium may be passed between a conveyance roller and an idle roller after being withdrawn from a corresponding cassette so as to check if the medium is double conveyed (i.e. to check whether two sheets are stuck together).

Figure 1:
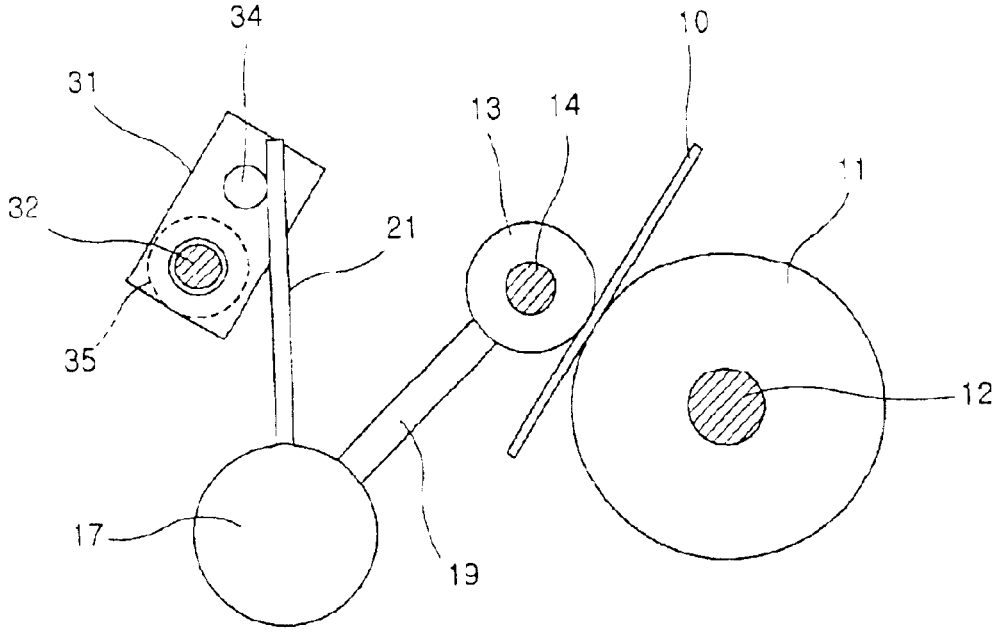
FIG. 1 is an exemplary view illustrating construction of a thickness measuring apparatus.
Figure 2:
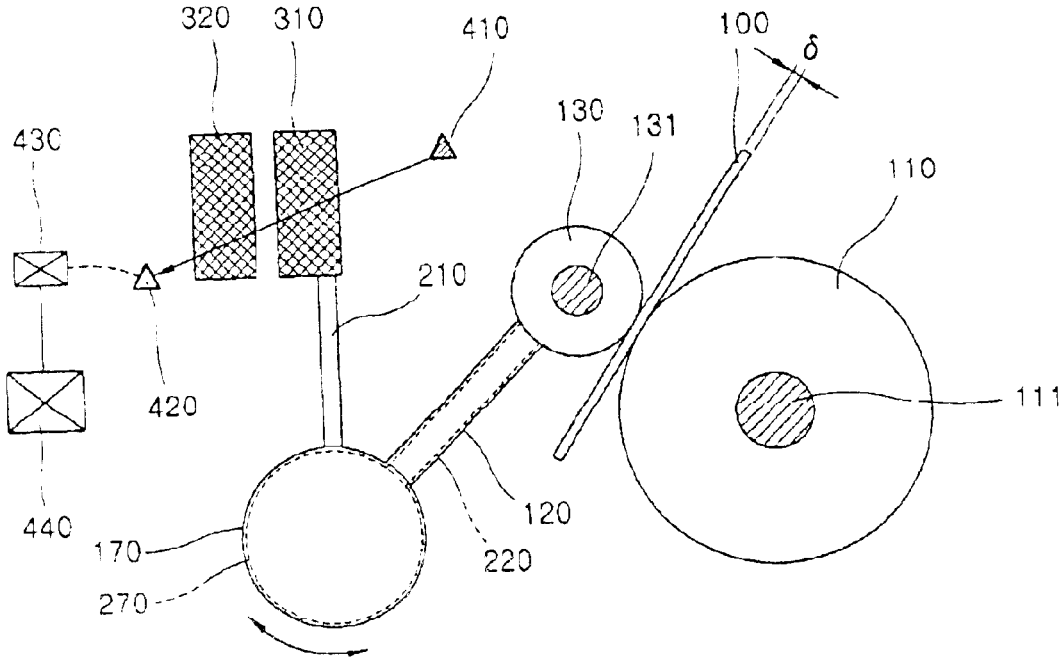
FIG. 2 is an exemplary view illustrating construction of a rotational displacement detecting apparatus and a thickness measuring apparatus.

FIG. 1 is an exemplary illustration of embodiments of the present invention including a conveyance unit including a conveyance roller 11 and/or an idle roller 13 installed to be rotatable at an idle rotational shaft 14 parallel to a conveyance rotational shaft 12 of the conveyance roller 11 and accessible to and isolated from the conveyance roller 11, so as to convey the medium 10 together with the conveyance roller 11. The conveyance unit may include a measuring shaft 17 and a first rotary arm 19. Measuring shaft 17 may be installed parallel to idle rotational shaft 14. One end of first rotary arm 19 may be fixed at idle rotational shaft 14. The other end of first rotary arm 19 may be fixed at measuring shaft 17 so that the idle rotational shaft 14 is rotated centering around the measuring shaft 17 when the medium 10 passes between the convey roller 11 and the idle roller 13. Second rotary arm 21 may be rotated according to rotation of measuring shaft 17 by being extended along a radial direction of the measuring shaft 17. Body 31 may be installed near an end portion of second rotary arm, so as to be rotatable centered around a rotational shaft 32 installed parallel to the measuring shaft 17. Hooking jaw 34 may be formed spaced apart from rotational shaft 32 so that body 31 may be rotated in a state of being in contact with second rotary arm 21 when second rotary arm 21 is rotated by the measuring shaft 17. Rotational displacement detecting unit 35 may be coupled at rotational shaft 32 of the body 31 and may detect a rotational displacement of body 31.

When medium 10 is inserted between conveyance roller 11 and idle roller 13, idle roller 13 may be moved from conveyance roller 11 a distance corresponding to the thickness of medium 10. Accordingly, measuring shaft 17 may be rotated corresponding to the thickness of the medium 10 by first rotary arm 19. Accordingly, second rotary arm 21 fixedly installed at measuring shaft 17 may be rotated. Body 31, being in contact with hooking jaw 34, near the end portion of second rotary arm 21, maybe rotated around a pivot of rotational shaft 32 according to the rotation of second rotary arm 21. Rotational displacement of body 31 may be detected by rotational displacement detecting unit 35 and a thickness of medium 10 may be calculated from the rotational displacement of rotational displacement detecting unit 35.

Rotational displacement detecting unit 35 may use a differential transformer (i.e. a rotary variable differential transformer) to accurately detect a rotational displacement corresponding to the thickness of medium 10 having a small thickness dimension. However, embodiments utilizing a differential transformer have some disadvantages. For instance, differential transformers are relatively expensive. Further, differential transformers should be fabricated and assembled very precisely. Therefore, their fabrication and assembling is expensive.

A thickness measuring apparatus of embodiments of the present invention may include a conveyance unit having a conveyance roller 110 and/or an idle roller 130 for conveying medium 100. Displacement transformation unit may be for transforming a displacement (δ) of idle roller 130 to a rotational displacement (θ) according to the thickness (δ) of medium 100 when medium 100 passes between conveyance roller 110 and idle roller 130. A rotational displacement detecting unit may be for detecting a rotational displacement by changing a quantity of light depending on the rotational displacement (θ). Thickness calculating unit 440 may be for calculating a thickness of medium 100 from rotational displacement detected by rotational displacement detecting unit. Medium 100 may be a bill, photocopy paper, and/or print paper used for either an ATM, a photocopier, or a printer.

Idle roller 130, which may be included in a conveyance unit, may be installed at rotational shaft 131, which may not be rotated but may rotatably support idle roller 130. Rotational shaft 131 may be installed to be accessible to or separated from the conveyance roller 110. Displacement transformation unit may transform linear displacement of rotational shaft 131 of idle roller 130 to rotational displacement of medium 100 passing conveyance roller 110 and idle roller 130. Displacement transformation unit may include a rotary arm 120 of which one end may be fixed at rotational shaft 131 of idle roller 130 and/or the other end may be fixed at transformation rotational shaft 170 so that rotary arm 120 may be rotated centering around transformation rotational shaft 170 by displacement (δ) of rotational shaft 131 of idle roller 130. For example, a small displacement (δ) of idle roller 130 may be transformed to a rotational displacement (θ) of transformation rotational shaft 170 by rotary arm 120.

Rotational displacement detecting unit may include an input unit 220, a detection rotational shaft 270, a rotational member 210, and/or a rotational displacement detecting unit. Input unit 220 may be for receiving rotational displacement (θ). Detection rotational shaft 270 may be rotated as much as corresponding to rotational displacement (θ) inputted to input unit 220. Rotational member 210 may be fixedly installed at detection rotational shaft 270 and may be rotated according to rotation of detection rotational shaft 270. Rotational displacement detecting unit may be installed at a free end of rotational member 210 and may detect a rotational displacement by changing a quantity of light received according to rotational displacement (θ).

Input unit 220 may include rotary arm 120 of displacement transformation unit and may receive a small displacement of idle roller 130. Rotary arm 120 may transmit displacement as a rotational displacement of transformation rotational shaft 170. Detection rotational shaft 270 may be coaxially formed with transformation rotational shaft 170 of displacement transformation unit, to receive rotational displacement (θ) from rotary arm 120. Since rotational displacement may be very small (i.e. due to the thickness of paper), the rotational displacement may need to be amplified. Rotational member 210 may be longer than rotary arm 120. Displacement of rotational displacement detecting unit which may be installed at a free end of rotational member 210 and may be increased for input of rotational displacement (θ). In embodiments, in order to amplify a small rotational displacement, an additional rotational displacement amplifying unit (not shown) of a link structure consisting of rotary arms with different lengths may be connected between detection rotational shaft 270 and transformation rotational shaft 170.

In embodiments, rotational displacement detecting unit may include a first light transmission member 310, a second light transmission member 320, a light receiving unit 420, and a rotational displacement calculating unit 430. First light transmission member 310 may be fixedly installed at a free end of rotational member 210 and may be moved according to rotation of rotational member 210. Second light transmission member 320 may be fixed to be overlapped with first light transmission member 310 when the first light transmission member 310 is moved. A light emitting unit 410 may be for irradiating light to first light transmission member 310 and second light transmission member 320. Light receiving unit 420 may be for detecting a quantity of light irradiated by light emitting unit 410 which may change as overlap between first light transmission member 310 and second light transmission member 320 changes. Rotational displacement calculating unit 430 may be for calculating a rotational displacement from the quantity of light detected by light receiving unit 420.

Light emitting unit 410 may be fixedly installed near first and second light transmission members 310 and 320 in order to irradiate light to be transmitted through first and second light transmission members 310 and 320 to light receiving unit 420. Light receiving unit 420 may be fixedly installed near first and second light transmission members 310 and 320 so as to detect light having passed first and second light transmission members 310 and 320. Rotational displacement calculating unit 430 may be connected to light receiving unit 420 and may calculate a rotational displacement (θ) of rotary arm 120 upon receiving a signal according to a change in the quantity of light of light receiving unit 420.

Figure 3:
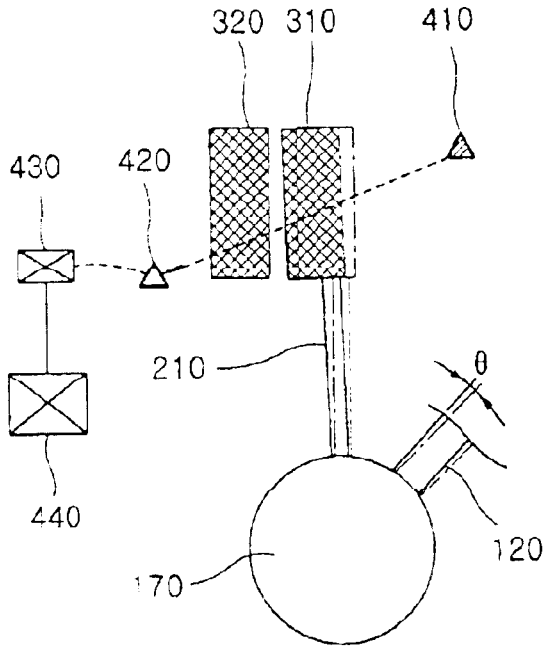
FIG. 3 is an exemplary conceptual view illustrating an operation of a rotational displacement detecting apparatus.
Figure 4:
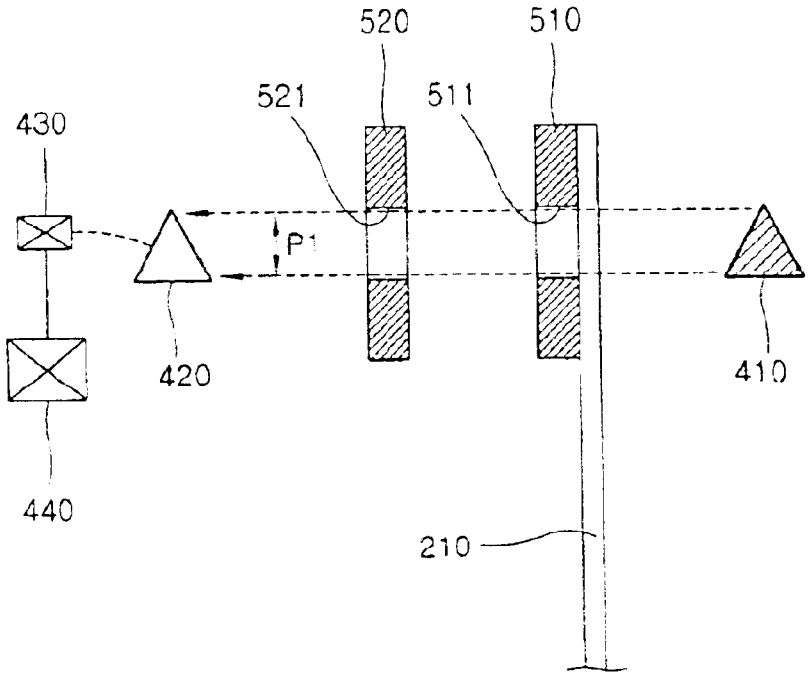
FIGS. 4 and 5 are exemplary conceptual views illustrating an operation of a rotational displacement detecting apparatus using a light transmission member with a slit.
Figure 5:
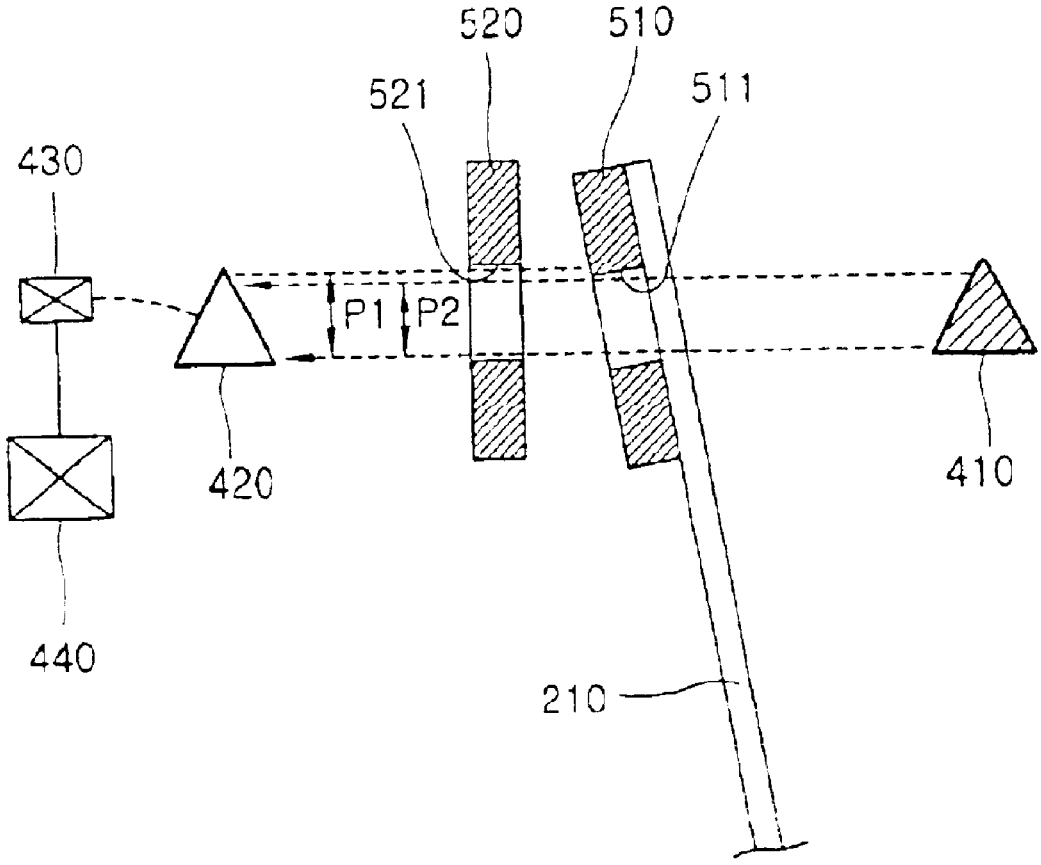

FIGS. 3, 4 and 5 are exemplary illustrations of second light transmission member 320 which may be fixed close to first light transmission member 310. First light transmission member 310 may be fixedly installed at a free end of rotational member 210. First light transmission member 310 and second light transmission member 320 may use a polarization filter or a slit in the direction in which light is irradiated to change the quantity of light received at light receiving unit 420. Particularly, the quantity of light may be changed as first and second light transmission members 310 and 320 are mutually interfered owing to a displacement of the first light transmission member 310 according to rotation of rotational member 210.

In exemplary embodiments where first and second light transmission members 310 and 320 are used as polarizing filters (i.e. embodiments illustrated in FIG. 3), rotational member 210 is rotated according to rotation of transformation rotational shaft 170. First rotational member 310 may be installed at a free end of rotational member 210. Rotational member 210 may be moved and overlapped with second rotational member 320 as much as corresponding to a rotational displacement (θ), thereby changing the quantity of light received by light receiving unit 420.

In embodiments, by installing a polarizing filter used for first light transmission member 310 and second light transmission member 320 such that the polarization direction can be vertical, light may be interrupted as much as the first light transmission member 310 and the second light transmission member 320 are overlapped. Light interruption may be detected by light receiving unit 420. Rotational displacement calculating unit 430 may calculate rotational displacement (θ) of rotary arm 120 from the quantity of light received at the light receiving unit 420.

In embodiments, first and second slits 511 and 521 may be sequentially disposed in a direction of light irradiation of the light emitting unit 410. As illustrated in exemplary FIGS. 4 and 5, first light transmission member 510 may be moved as much as the rotational displacement (θ) of rotational member 210. First and second slits 511 and 521 may be formed at first and second light transmission members 510 and 520 and may be diverged from each other. Consequently the quantity of light detected by light receiving unit 420 may change. Rotational displacement calculating unit 430 may calculate rotational displacement (θ) of rotary arm 120 according to the quantity of light detected by light receiving unit 420.

A rotational displacement detecting apparatus may be applicable in many diverse fields as an apparatus for measuring infinitesimal rotational displacement. A thickness calculating unit may calculate a thickness of a medium passing a conveyance roller and an idle roller. Rotational displacement may be calculated by a rotational displacement calculating unit of rotational displacement detecting apparatus. Rotational displacement and thickness of a medium may be calculated on a basis of relations ($l=r\theta$) between a length (l) of an arc, a radius (r) of the arc, and an angle (θ) of the arc. Mathematical equations may be used e.g. relations among lengths of each side of a triangle, an interior angle, and an exterior angle of the triangle).

Embodiments of the present invention have many advantages. For example, unlike a RVDT which is relatively costly and needs relatively high precision, a comparatively low-priced light emitting device, light receiving device, first light transmission member, and/or second light transmission member may be used. Accordingly, embodiments of the present invention are advantageous, because manufacturing costs may be reduced. Further, since parts do not need to have the same high precision as a RVDT, fabrication is simplified. Since a rotational displacement detecting apparatus is used for a thickness measuring apparatus for measuring a thickness of a medium conveyed by a conveyance unit, thickness of a medium can be detected by a relatively simple apparatus.

Objects of embodiments of the present invention are to provide a rotational displacement detecting apparatus that is capable of detecting a rotational displacement with a simple structure and to provide a thickness measuring apparatus that is capable of measuring a thickness of a medium by using the rotational displacement apparatus with the simple structure.

To achieve these and other advantages and in accordance with the purpose of embodiments of the present invention, as embodied and broadly described herein, there may be provided a thickness detecting apparatus including: a conveyance unit having a conveyance roller and an idle roller for conveying a medium; a displacement transforming unit for transforming a displacement of the idle roller to a rotational displacement depending on the thickness of the medium when the medium passes between the conveyance roller and the idle roller; a rotational displacement detecting unit having a detector for detecting a rotational displacement by changing a quantity of light according to the rotational displacement; and/or a thickness calculating unit for calculating the thickness of the medium from the rotational displacement detected by the rotational displacement detecting unit.

To achieve the above objects, there may also provided a thickness measuring apparatus including: a conveyance unit having a conveyance roller and an idle roller for conveying a medium; a rotary arm of which one end is fixedly installed at a rotational shaft of the idle roller and the other end is fixedly installed at a transformation rotational shaft installed parallel to a rotational shaft of the idle roller, so as to rotate the transformation rotational shaft according to displacement of the rotational shaft of the idle roller caused when the medium passes the conveyance roller and the idle roller; a rotational member fixedly installed at the transformation rotational shaft so as to be rotated together with the transformation rotational shaft; a first light transmission member fixedly installed at a free end of the rotational member and moved according to rotation of the rotational member; a second light transmission member fixed to be overlapped at some portion with the first light transmission member when the first light transmission member is moved; a light emitting unit for irradiating light to the first light transmission member and the second fight transmission member; a light receiving unit for detecting a quantity of light irradiated by the light emitting unit which is changed as the first light transmission member and the second light transmission member are overlapped; a rotational displacement calculating unit for calculating a rotational displacement from the quantity of light detected by the light receiving unit; and/or a thickness calculating unit for calculating a thickness of the medium from the rotational displacement calculated by the rotational displacement calculating unit.

In order to achieve at least some objects, there may be provided a rotational displacement detecting apparatus including: an input unit for receiving a rotational displacement; a rotational shaft fixedly installed at the rotational shaft and rotated according to the rotational displacement of the rotational shaft; and/or a rotational displacement detecting unit installed at a free end of the rotational member and detecting a rotational displacement by changing quantity of light according to the rotational displacement.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. An apparatus comprising an optical sensor configured to detect thickness of paper, the optical sensor comprises a light detector configured to receive light and at least one component configured to change a quantity of the light received at the light detector according to thickness of paper, wherein the component is physically coupled to a first arm, the first arm is coupled to a pivot, a second arm is coupled to the pivot, the second arm is physically coupled to a cam and the cam is configured to move a distance corresponding to thickness of paper to detect thickness of paper.

2. The apparatus of claim 1, wherein paper is at least one of legal tender, a receipt, a card, a check, or a document.

3. The apparatus of claim 1, wherein the optical sensor comprises at least one optically polarized substrate.

4. The apparatus of claim 3, wherein the optical sensor comprises two optically polarized substrates.

5. The apparatus of claim 1, wherein the optical sensor comprises at least one substrate comprising an aperture.

6. The apparatus of claim 5, wherein the optical sensor comprises two substrates each comprising an aperture.

7. The apparatus of claim 1, wherein the optical sensor comprises:

a light source to emit the light.

8. The apparatus of claim 1, wherein the component is configured to decrease the quantity of light received at the light detector according to thickness of paper.

9. The apparatus of claim 1, wherein the first arm is longer than the second arm.

10. A thickness detecting apparatus comprising:

a conveyance unit having a conveyance roller and an idle roller for conveying a medium;

a displacement transforming transformation unit for transforming displacements of the idle roller to rotational displacements depending on the thickness of the medium when the medium passes between the conveyance roller and the idle roller;

a rotational displacement detecting unit having a detector for detecting a rotational displacement by changing a quantity of light according to the rotational displacement; and a thickness calculating unit for calculating the thickness of the medium from the rotational displacement detected by the rotational displacement detecting unit, wherein the displacement transformation unit is formed as a rotary arm of which one end is rigidly coupled to the idle roller and the other end is fixed at a transformation rotational shaft so that the rotary arm is rotated centering around the transformation rotational shaft by a displacement of the idle roller, and transforms a displacement of the end of the rotary arm to a rotational displacement of the transformation rotational shaft.

11. The apparatus of claim 10, wherein the rotational displacement detecting unit comprises:

the transformation rotational shaft parallel to a rotational axis of the idle roller;

a rotational member fixed at the transformation rotational shaft and rotated according to the rotational displacement received from the displacement transformation unit;

a first light transmission member fixedly installed at a free end of the rotational member and moved according to rotation of the rotational member;

a second light transmission member fixed to be overlapped with the first light transmission member at a certain portion when the first light transmission member is moved;

a light emitting unit for irradiating light to the first and second light transmission members;

light receiving unit for detecting quantity of light irradiated by the light emitting unit which is changed as the first light transmission member and the second light transmission member are overlapped; and a rotational displacement calculating unit for calculating a corresponding rotational displacement from the quantity of light detected by the light receiving unit.

12. The apparatus of claim 11, wherein the first and second light transmission member are polarizing filters.

13. The apparatus of claim 11, wherein the first and second light transmission member are plates with a slit formed therein.

14. The apparatus of claim 11, wherein the rotational member is longer than the rotary arm.

15. A rotational displacement detecting apparatus comprising:

an input unit for receiving a rotational displacement;

a rotational member fixedly installed at a rotational shaft coupled to the input unit and rotated according to the rotational displacement of the rotational shaft; and a rotational displacement detecting unit installed at a free end of the rotational member and detecting a rotational displacement by changing quantity of light according to the rotational displacement, wherein the rotational displacement detecting unit comprises, a first light transmission member fixedly installed at a free end of the rotational member and moved according to rotation of the rotational member, a second light transmission member fixed to be overlapped with the first light transmission member at a certain portion when the first light transmission member is moved, a light emitting unit for irradiating light to the first and second light transmission members, light receiving unit for detecting quantity of light irradiated by the light emitting unit which is changed as the first light transmission member and the second light transmission member are overlapped, and a rotational displacement calculating unit for calculating a rotational displacement from the quantity of light detected by the light receiving unit.

16. The apparatus of claim 15, wherein the input unit receives a rotational displacement as one end thereof is fixedly installed at the rotational shaft and the other end of the input unit is coupled with a member where displacement takes place, so as to receive a rotational displacement.

17. The apparatus of claim 15, wherein the first and second light transmission member are polarizing, filters.

18. The apparatus of claim 15, wherein the first and second light transmission member are plates with a slit formed therein.

19. A thickness measuring apparatus, comprising:

a conveyance unit having a conveyance roller and an idle roller;

a rotary arm of which one end is coupled to a rotational shaft of the idle roller and the other end is fixedly installed at a transformation rotational shaft installed parallel to a rotational shaft of the idle roller, so as to rotate the transformation rotational shaft according to displacement of the rotational shaft of the idle roller;

a rotational member fixedly installed at the transformation rotational shaft so as to be rotated together with the transformation rotational shaft;

a light transmission member fixedly installed at a free end of the rotational member and moved according to rotation of the rotational member;

a light receiving unit for detecting a quantity of received light that is changed as the light transmission member is moved according to said rotation;

a rotational displacement calculating unit for calculating a rotational displacement from the quantity of light detected by the light receiving unit; and a thickness calculating unit for calculating a thickness of a medium from the rotational displacement calculated by the rotational displacement calculating unit.

20. The apparatus of claim 19, wherein the conveyance unit conveys a medium being at least one of legal tender, a receipt, a card, a check or a document.

21. The apparatus of claim 19, wherein the light transmission member comprises:

a first light transmission member fixedly installed at the free end of the rotational member and moved according to the rotation of the rotational member; and a second light transmission member fixed to be overlapped at some portion with the first light transmission member when the first light transmission member is moved, wherein the light receiving unit detects the quantity of light that is changed as the first light transmission member and the second light transmission member are moved relative to each other.

22. A thickness measuring apparatus, comprising:

conveyance means having a conveyance roller and an idle roller for conveying;

rotary arm means of which one end is coupled to a rotational shaft of the idle roller and the other end is fixedly installed at a transformation rotational shaft installed parallel to a rotational shaft of the idle roller, for rotating the transformation rotational shaft according to displacement of the rotational shaft of the idle roller;

rotational member means fixedly installed at the transformation rotational shaft for rotating together with the transformation rotational shaft;

light transmission member means fixedly installed at a free end of the rotational member for moving according to rotation of the rotational member means;

light receiving means for detecting a quantity of received light that is changed as the light transmission member means is moved according to said rotation;

rotational displacement calculating means for calculating a rotational displacement from the quantity of light detected by the light receiving means; and thickness calculating means for calculating a thickness from the rotational displacement calculated by the rotational displacement calculating means.

* * * * *